US010682681B2

(12) United States Patent
Nishimura et al.

(10) Patent No.: US 10,682,681 B2
(45) Date of Patent: Jun. 16, 2020

(54) PRESS FORMING APPARATUS AND PRESS FORMING METHOD

(71) Applicant: NIPPON STEEL & SUMITOMO METAL CORPORATION, Tokyo (JP)

(72) Inventors: Ryuichi Nishimura, Tokyo (JP); Kenichiro Otsuka, Tokyo (JP); Keiji Ogawa, Tokyo (JP); Yoshiaki Nakazawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 720 days.

(21) Appl. No.: 14/893,786

(22) PCT Filed: Jun. 27, 2014

(86) PCT No.: PCT/JP2014/067122
§ 371 (c)(1),
(2) Date: Nov. 24, 2015

(87) PCT Pub. No.: WO2015/002077
PCT Pub. Date: Jan. 8, 2015

(65) Prior Publication Data

US 2016/0114379 A1 Apr. 28, 2016

(30) Foreign Application Priority Data

Jul. 3, 2013 (JP) ..... 2013-139636

(51) Int. Cl.
*B21D 22/22* (2006.01)
*B21D 22/26* (2006.01)
*B21D 24/04* (2006.01)

(52) U.S. Cl.
CPC ..... *B21D 22/22* (2013.01); *B21D 22/26* (2013.01); *B21D 24/04* (2013.01)

(58) Field of Classification Search
CPC ..... B21D 22/20; B21D 22/21; B21D 22/22; B21D 22/24; B21D 22/26; B21D 24/00;
(Continued)

(56) References Cited

U.S. PATENT DOCUMENTS 5,433,099 A 7/1995 Katsuhiro et al.

FOREIGN PATENT DOCUMENTS

CN 2520962 Y * 11/2002
CN 2520962 Y 11/2002
(Continued)

OTHER PUBLICATIONS

Machine Translation of CN 201921944, 3 Pages.*
(Continued)

*Primary Examiner* — Gregory D Swiatocha
(74) *Attorney, Agent, or Firm* — Birch, Stewart, Kolasch & Birch, LLP

(57) ABSTRACT

A press forming apparatus includes: a punch; a blank holder disposed adjacent to the punch; a die being a counterpart of the punch; and a pad disposed to face the punch. The punch has a tip surface, an outside surface, and a stepped surface having shapes corresponding to a web portion, vertical wall portions, and a flange portion of a product, respectively. When the punch and the die are relatively moved in a pressing direction in a state where a middle portion in a width direction of a workpiece is sandwiched by the pad and punch and an outer peripheral portion in the width direction of the workpiece is bound by the blank holder and the die, the workpiece's outer peripheral portion in the width direction gets out from between the blank holder and the die, and the flange portion is shaped by the die and the punch's stepped surface.

6 Claims, 7 Drawing Sheets

(58) Field of Classification Search
CPC ..... B21D 24/04; B21D 24/06; B21D 24/08; B21D 24/10; B21D 24/12
See application file for complete search history.

(56) References Cited

FOREIGN PATENT DOCUMENTS

| | | | | | |
|---|---|---|---|---|---|
| CN | 201921944 | U | * | 8/2011 | |
| DE | 10331939 | A1 | * | 2/2005 | ..... B21D 22/22 |
| DE | 102011110732 | A1 | * | 2/2013 | ..... B21D 24/06 |
| JP | 63-145519 | U | | 9/1988 | |
| JP | 63-242423 | A | | 10/1988 | |
| JP | 4-190931 | A | | 7/1992 | |
| JP | 5-154570 | A | | 6/1993 | |
| JP | 08001243 | A | * | 1/1996 | |
| JP | 2004-154786 | A | | 6/2004 | |
| JP | 2004154786 | A | * | 6/2004 | |
| JP | 2004-188474 | A | | 7/2004 | |
| JP | 2005-95925 | A | | 4/2005 | |
| JP | 2013-780 | A | * | 1/2013 | |

OTHER PUBLICATIONS

Machine Translation of CN 2520962, 2 Pages.*
Machine Translation of DE 102011110732, 4 Pages.*
Machine Translation of DE 10331939, 3 Pages.*
Machine Translation of JP 2004154786, 6 Pages.*
Machine Translation of JP 2013000780, 4 Pages.*
International Search Report, issued in PCT/JP2014/067122, dated Aug. 26, 2014.
Written Opinion of the International Searching Authority, issued in PCT/JP2014/067122, dated Aug. 26, 2014.
International Preliminary Report on Patentability and Written Opinion of the International Searching Authority (Forms PCT/IB/338, PCT/IB/373 and PCT/ISA/237) for International Application No. PCT/JP2014/067122, dated Jan. 14, 2016.
Chinese Office Action and Search Report, dated Jul. 5, 2016, for corresponding Chinese Application No. 201480035607.1.
Indian Examination Report for corresponding Indian Application No. 10745/DELNP/2015, dated Mar. 25, 2019, with English translation.

* cited by examiner

--RELATED ART--

--RELATED ART--

--RELATED ART--

--RELATED ART--

--RELATED ART--

--RELATED ART--

--RELATED ART--

--RELATED ART--

--RELATED ART--

--RELATED ART--

PRESS FORMING APPARATUS AND PRESS FORMING METHOD

TECHNICAL FIELD

The present invention relates to a press forming apparatus and a press forming method to form a product with a hat-shaped cross section, for example, by drawing from a planar workpiece made of metal. More detailedly, the present invention relates to the press forming apparatus and the press forming method capable of preventing a deformation of the workpiece at a time that a punch and a die are separated, without using a locking mechanism, when a pad together with a blank holder is used in addition to the punch and the die in press forming.

BACKGROUND ART

A vehicle body component (vehicle framework component such as members, pillars, or a floor tunnel, for example) of an automobile can be fabricated by press forming a planar workpiece made of metal to have a hat-shaped cross section.

FIG. 1A and FIG. 1B are schematic views showing an example of a product with a hat-shaped cross section, FIG. 1A being a side view and FIG. 1B being a I-I cross-sectional view of FIG. 1A. The product 10 with the hat-shaped cross section has a web portion 10*a*, a first vertical wall portion 10*b* extending toward one side of the web portion 10*a*, a first flange portion 10*c* further extending from the first vertical wall portion 10*b*, a second vertical wall portion 10*b* extending toward the other side of the web portion 10*a*, and a second flange portion 10*c* further extending from the second vertical wall portion 10*b*.

In the example of FIG. 1A and FIG. 1B, the web portion 10*a* of the product 10 is provided with inclinations in a front section and a rear section in a longitudinal direction. As described above, in the product 10, there is a case where a total of section line lengths substantially changes in the longitudinal direction. Here, the "total of section line lengths" is obtained by adding each section line length of the web portion 10*a*, the first and second vertical wall portions 10*b*, and the first and second flange portions 10*c*.

Further, with regard to the vertical wall portions 10*b* of the product 10, one is vertical to the flange portion 10*c* and the other is inclined from a state of being vertical to the flange portion 10*c*, inclinations being different in both sides. As described above, there is a case where a cross-sectional shape of the product 10 is asymmetric.

FIG. 2A and FIG. 2B are schematic views showing an example of a product with a hat-shaped cross section, FIG. 2A being a side view and FIG. 2B being a II-II cross-sectional view of FIG. 2A. Note that the same reference numeral is granted to a component the same as that of the product with the hat-shaped cross section of FIG. 1A and FIG. 1B and explanation thereof will be omitted.

In FIG. 2A and FIG. 2B is shown an example in which a web portion 10*a* of a product 10 is provided with inclinations in a front section and a rear section in a longitudinal direction, a lower surface of the product 10 is also similarly provided with inclinations, and a total of section line lengths does not change in a longitudinal direction. Further, the above is the example in which a cross-sectional shape of the product 10 is symmetric.

FIG. 3A and FIG. 3B are schematic views showing an example of a product of a hat-shaped cross section, FIG. 3A being a plan view and FIG. 3B being a cross-sectional view of FIG. 3A. Note that the same reference numeral is granted to a component the same as that of the product with the hat-shaped cross section of FIG. 1A and FIG. 1B, and explanation thereof will be omitted.

In FIG. 3A and FIG. 3B is shown the example in which an entire product 10 is bent unilaterally.

Note that though the flange portion 10*c* is provided along an entire length in the longitudinal direction in the product 10 with the hat-shaped cross section shown in FIG. 1A, FIG. 1B, FIG. 2A, FIG. 2B, FIG. 3A, and FIG. 3B, there are cases where a flange portion 10*c* is provided in a part of a longitudinal direction.

The product 10 with the hat-shaped cross section as above can be fabricated by press forming in which a punch and a die are used, and at that time, a pad is used together with a blank holder.

FIG. 4A to FIG. 4C are cross-sectional views schematically showing a processing flow of a case where a pad is used together with blank holders in press forming, FIG. 4A showing a sandwiching and binding time of a workpiece, FIG. 4B showing a pushing time, and FIG. 4C showing a starting time of separating operation of the punch and the die after a bottom dead center is reached, respectively. In FIG. 4A to FIG. 4C, a case is shown where a web portion 10*a*, vertical wall portions 10*b*, and flange portions 10*c* are formed in the workpiece when an upper forming tool is lowered from a top dead center to the bottom dead center.

FIG. 4A to FIG. 4C show the workpiece 50 and a forming tool 20 which a press forming apparatus has. In the metal forming tool 20, the upper forming tool 40 is constituted with the die 41 and the pad 42 disposed to face the punch 31, and a lower forming tool 30 is constituted with the punch 31, the blank holders 32 disposed adjacent to the punch 31.

The punch 31 of the lower forming tool 30 has a tip surface 31*a* having a shape corresponding to the web portion 10*a*, and an outside surface 31*b* having a shape corresponding to the vertical wall portions 10*b*. On the other hand, the die 41 of the upper forming tool 40 has a recessed portion and an inside surface 41*a* thereof has a shape corresponding to the outside surface 31*b* of the punch.

Further, the pad 42 is disposed in the recessed portion of the die 41, and the pad 42 is mounted on the die 41 via a pad pressure mechanism (for example, a spring or a gas cylinder) 43. The pad 42 mounted as above is slidable in a pressing direction. A tip surface (a surface facing the tip surface 31*a* of the punch) of the pad 42 has a shape corresponding to the tip surface 31*a* of the punch. On the other hand, the blank holders 32 are disposed on both sides of the punch 31, and the blank holder 32 is supported slidably in the pressing direction by a blank holder pressure mechanism (for example, a spring, a hydraulic cylinder, or a gas cylinder) 33. Here, the pressing direction means a direction where the punch 31 and the die 41 relatively move at a time of press forming, and in the metal forming tool 20 shown in FIG. 4A to FIG. 4C, a vertical direction is the pressing direction.

In press forming using the metal forming tool 20 with such a configuration, the planar workpiece 50 made of metal is disposed between the die 41 and the punch 31. When the upper forming tool 40 is lowered from the top dead center in such a state, the pad 42 abuts on the workpiece 50 and the pad pressure mechanism 43 is compressed. Thereby, the pad 42 is pressed to the workpiece 50 by a restoring force of the pad pressure mechanism 43, and as shown in FIG. 4A, a middle portion in a width direction of the workpiece 50 is sandwiched by the pad 42 and the punch 31.

Further, the die 41 abuts on the blank holder 32 via the workpiece 50 and the blank holder pressure mechanism 33 is compressed. Thereby, the blank holder 32 is pressed to the workpiece 50 by a restoring force of the blank holder pressure mechanism 33, and an outer peripheral portion in the width direction of the workpiece 50 is bound by the blank holder 32 and the die 41.

Here, timings of sandwiching the middle portion by the pad 42 and the punch 31 and of binding the outer peripheral portion by the blank holder 32 and the die 41 are properly set in corresponding with a shape or the like of the product. For example, there is a case where sandwiching the middle portion by the pad 42 and the punch 31 is carried out simultaneously with binding the outer peripheral portion by the blank holder 32 and the die 41. Further, there is a case where the outer peripheral portion is bound by the blank holder 32 and the die 41 after the middle portion is sandwiched by the pad 42 and the punch 31. Further, there is a case where the middle portion is bound by the pad 42 and the punch 31 after the outer peripheral portion is sandwiched by the blank holder 32 and the die 41.

In a state where the middle portion in the width direction of the workpiece 50 is sandwiched and the outer peripheral portion is bound, the upper forming tool 40 is further lowered as shown in FIG. 4B. Thereby, the punch 31 and the die 41 are relatively moved and the workpiece 50 is pushed into the recessed portion of the die 41 together with the punch 31 to draw the workpiece 50, whereby press forming is carried out.

At a time of press forming, since the workpiece 50 is pushed into the recessed portion of the die 41 together with the punch 31, both end positions of the workpiece 50 move toward the recessed portion of the die 41. Therefore, a binding length L of the workpiece 50 bound by the blank holder 32 and the die 41 becomes shorter as press forming progresses (see FIG. 4A and FIG. 4B).

Then, when the upper forming tool 40 reaches the bottom dead center, the web portion 10*a* is shaped by the tip surface 31*a* of the punch 31 and the pad 42, and the vertical wall portion 10*b* is shaped by the outside surface 31*b* of the punch 31 and the die 41. Further, the flange portion 10*c* is shaped by the blank holder 32 and the die 41. Consequently, the workpiece 50 is formed to have a hat-shaped cross section. As a result that the upper forming tool 40 is raised in a state where the upper forming tool 40 reaches the bottom dead center as shown in FIG. 4C, the punch 31 and the die 41 relatively move and are separated.

In such press forming using the pad 42 together with the blank holder 32, the middle portion in the width direction of the workpiece 50 is sandwiched by the pad 42. Thereby, in a process of forming the web portion 10*a*, the vertical wall portion 10*b*, and the flange portion 10*c* in the workpiece 50 (hereinafter, also simply referred to as a "forming process"), in a case where a shape of a product is an asymmetric shape, for example, there can be reduced occurrence of an unintended excessive displacement in the web portion 10*a* in a case where inclinations of the vertical wall portions 10*b* are substantially different in both sides. Further, by an effect of sandwiching and binding by the pad 42 and the blank holder 32, there can be reduced formation of a wrinkle in the web portion 10*a*, the vertical wall portion 10*b*, the flange portion 10*c*, or near a boundary between the web portion 10*a* and the vertical wall portion 10*b*, or in the periphery of a ridge line portion of the flange portion 10*c* and the vertical wall portion 10*b*, and sandwiching and binding by the pad 42 and the blank holder 32 is particularly effective in forming a product having a shape in which a total of section line lengths substantially changes in a longitudinal direction, or a shape which is bent in a side view or a top view (see FIG. 2 and FIG. 3).

In press forming using a pad together with a blank holder, there are a case of using a pad which abuts on the entire of a web portion 10*a* to be formed and a case of using a pad which abuts on a part of a web portion 10*a* to be formed, as the pad. In the former case, the web portion 10*a* is shaped by a tip surface of a punch and the pad, and in the latter case, the web portion 10*a* is shaped mainly by a tip surface of a punch, the pad, and a die.

Further, the die 41 is sometimes constituted with a single member as shown in FIG. 4A to FIG. 4C, and is sometimes constituted with a plurality of members as shown in FIG. 5.

FIG. 5 is a cross-sectional view schematically showing a sandwiching and binding time of a workpiece of press forming using a die constituted by the plurality of members. FIG. 5 shows the workpiece 50 and a metal forming tool 20 which a press forming apparatus has. The metal forming tool 20 has a basic configuration the same as that of the metal forming tool shown in FIG. 4A to FIG. 4C, but the die constituted with the plurality of members is used as the die 41 having a recessed portion. The die 41 is constituted with a first block 411 forming one inside surface 41*a* of the recessed portion, a second block 411 forming the other inside surface 41*a* of the recessed portion, and a plate 412 fixing the first block 411 and the second block 411. A pad 42 is mounted on the plate 412 via a pad pressure mechanism 43.

The product with the hat-shaped cross section having been press formed is properly subjected to a processing such as trimming and is shaped into a finished product. On that occasion, there is a case where the flange portions 10*c* are removed, by cutting or the like, from the product with the hat-shaped cross section so that a finished product constituted with the web portion 10*a*, the first vertical portion 10*b*, and the second vertical wall portion 10*b* is made.

Press forming using the pad together with the blank holder is also applicable to a case where a flange portion 10*c* is provided in a part of a longitudinal direction in a product with a hat-shaped cross section, by properly altering a shape of a workpiece. Further, press forming using the pad together with the blank holder is applicable not only to a case of the hat-shaped cross section but also to a case of press forming a product in which a flange portion 10*c* is provided in only one side. To the product in which the flange portion 10*c* is provided in only one side, there corresponds a product constituted with a web portion 10*a*, a first vertical wall portion 10*b*, a second vertical wall portion 10*b*, and a first flange portion 10*c*. Alternatively, there corresponds a product constituted with a web portion 10*a*, a first vertical wall portion 10*b*, a second vertical wall portion 10*b*, and a second flange portion 10*c*.

Here, in press forming using the pad together with the blank holder, there is an apprehension that a deformation occurs in the workpiece when the punch and the die are separated after shaping of the workpiece into a predetermined shape. When the punch 31 and the die 41 are separated, since the blank holder 32 is pressed to the workpiece 50 in order to bind the workpiece 50, the flange portion 10*c* of the workpiece 50 is pressed in a direction shown by a dashed line arrow in FIG. 4C by the blank holder 32. On the other hand, since the pad 42 is pressed to the workpiece 50 in order to sandwich the workpiece 50, the web portion 10*a* of the workpiece 50 is pressed in a direction shown by a solid line arrow in FIG. 4C by the pad 42. Consequently, the formed workpiece 50 is deformed.

In order to prevent the workpiece from being deformed when the punch and the die are separated as described above, a locking mechanism has been conventionally used.

In a case of a vehicle body component of an automobile, in particular, since a pressing force at a time of sandwiching and binding a workpiece by a pad and a blank holder is normally quite large, 2 tonf or more, a deformation of the workpiece at a time of separating a punch and a die being inevitable, a locking mechanism is essential.

With regard to press forming using the pad together with the blank holder, various suggestions have been conventionally made, such as by Patent Literature 1 and Patent Literature 2, for example.

In Patent Literature 1, there is suggested a drawing forming tool which has a locking mechanism temporarily binding a pad (cushion) in a lower forming tool side at a time of separating a punch of an upper forming tool and a die of a lower forming tool. The locking mechanism of the drawing forming tool is constituted with a cam driver, a parent cam member, and a child cam member, and the pad of the lower forming tool is mechanically bound to delay a timing of rising. Thereby, it is said that compared with a case where binding of a pad is controlled by hydraulic pressure, a deviation of timing can be prevented and that a deformation of a workpiece can be prevented.

Further, in Patent Literature 2, there is suggested a metal forming tool a lower forming tool of which is constituted with a punch and a blank holder, an upper forming tool of which is constituted with a die and a pad, and which has a locking mechanism built-in. That locking mechanism binds the pad to the die when the die reaches a bottom dead center between the pad and the die, and releases binding of the pad to the die when the die is raised by a predetermined length after passing through the bottom dead center. In an example thereof, a cam is used for materializing the locking mechanism. It is said that such a locking mechanism of Patent Literature 2 can prevent a deformation of a workpiece and can heighten a productivity by being applied to a transfer press apparatus.

CITATION LIST

Patent Literature

Patent Literature 1: Japanese Laid-open Patent Publication No. 4-190931

Patent Literature 2: Japanese Laid-open Patent Publication No. 63-242423

Patent Literature 3: Japanese Laid-open Patent Publication No. 2004-154786

SUMMARY OF INVENTION

Technical Problem

As described above, in press forming, usage of a pad together with a blank holder can reduce occurrence of an unintended excessive displacement in a web portion also in a case of press forming a product with an asymmetric cross section. Further, there can be reduced formation of a wrinkle in a web portion, a vertical wall portion, a periphery of a ridge line portion in a neighborhood of a boundary between the web portion and the vertical wall portion, a flange portion, or a neighborhood of a boundary of the flange portion and the vertical wall portion, in a case where a total of section line lengths changes in a longitudinal direction and also in a case where a bend exists in a side view or a top view. However, there is an apprehension that a deformation occurs in a workpiece having been shaped into a predetermined shape at a time of separating a punch and a die, and in order to prevent the above, a locking mechanism is used.

When the locking mechanism is used, occurrence of the deformation in the workpiece can be prevented theoretically at a time of separating the punch and the die. However, if the locking mechanism is materialized by control by a gas cylinder or a hydraulic cylinder, a timing to activate the locking mechanism sometimes deviates, and in such a case, a deformation occurs in the press-formed workpiece. Further, there is a possibility that the number of products capable of being press formed per unit time decreases, reducing a productivity.

On the other hand, it is said that according to the locking mechanism using the cam of Patent Literature 1, a deformation due to a deviation of a timing can be prevented, and that according to the locking mechanism using the cam of Patent Literature 2, a productivity can be heightened. However, there is an apprehension that the locking mechanism using the cam leads to increase in an equipment cost or a maintenance cost due to a complex structure of a metal forming tool or a pressing apparatus, or to increase in a metal forming tool size.

Further, with regard to a press forming method, Patent Literature 3 discloses a configuration in which a surface tool is disposed to face at least a part of a die face surface at a predetermined interval. In press forming of Patent Literature 3, when transferring a shape by sandwiching a plate material between a male forming tool and a female forming tool, with the male forming tool and the female forming tool starting to bend the plate material in consort, the plate material is pulled into between the male forming tool and the female forming tool while a free end portion of the plate material is separated from the die face surface and a distance between the free end portion and the die face surface is kept in a predetermined range by the surface tool, and forming is carried out while an almost constant bending plastic strain is given to the plate material passing through a die edge portion.

However, the press forming method of Patent Literature 3 is a press forming method in which wrinkle pressing is not carried out, that is, a press forming method in which a product is formed by a bending processing, and is different from a press forming method using a blank holder for pressing wrinkles as in the invention of the present application, that is, the press forming method in which a product is formed by drawing.

As long as a product has a hat-shaped cross section with a simple shape in which a total of section line lengths is almost constant in a longitudinal direction, a cross-sectional shape of which is symmetric, and which extends straight in the longitudinal direction, forming by a bending processing is also possible. However, by bending, it is difficult to form the product with the hat-shaped cross section in which the total of section line lengths changes in the longitudinal direction, the cross-sectional shape of which is asymmetric, or which bends in either one of directions in the longitudinal direction, as exemplified in FIG. 1A, FIG. 1B, FIG. 2A, FIG. 2B, FIG. 3A, and FIG. 3B.

The present invention is made in view of the above circumstances, and an object thereof is to provide a press forming apparatus and a press forming method capable of preventing a deformation of a workpiece when separating a punch and a die without using a locking mechanism in a case of using a pad together with a blank holder in addition to the punch and the die in press forming.

Solution to Problem

The gist of the present invention for solving the aforementioned problem is described below.

[1] A press forming apparatus forming a product by drawing from a plane workpiece made of metal, the product having a web portion, a first vertical wall portion extending toward one side of the web portion, a second vertical wall portion extending toward the other side of the web portion, at least one of a first flange portion further extending from the first vertical wall portion in at least a part of a longitudinal direction and a second flange portion further extending from the second vertical wall portion in at least a part of the longitudinal direction, the press forming apparatus including:

a punch;

a blank holder disposed adjacent to the punch and slidable in a pressing direction;

a die being a counterpart of the punch; and a pad disposed to face the punch and slidable in the pressing direction, wherein the punch has a tip surface, an outside surface, and a stepped surface having shapes corresponding to the web portion, the vertical wall portions, and the flange portion of the product, respectively, and wherein as a result that the punch and the die are relatively moved in the pressing direction in a state where a middle portion in a width direction of the workpiece is sandwiched by the pad and the punch and an outer peripheral portion in the width direction of the workpiece is bound by the blank holder and the die, the outer peripheral portion in the width direction of the workpiece gets out from between the blank holder and the die and the flange portion is shaped by the die and the stepped surface of the punch.

[2] The press forming apparatus according to [1], including a mechanism to keep an interval so that an interval between the blank holder and the die may not become equal to or less than a predetermined interval.

[3] The press forming apparatus according to [2], wherein the predetermined interval g satisfies $t \times 0.5 \leq g \leq t \times 1.5$, with a plate thickness of the workpiece before a processing being t.

[4] A press forming method to form a product by drawing from a plane workpiece made of metal, the product having a web portion, a first vertical wall portion extending toward one side of the web portion, a second vertical wall portion extending toward the other side of the web portion, at least one of a first flange portion further extending from the first vertical wall portion in at least a part of a longitudinal direction and a second flange portion further extending from the second vertical wall portion in at least a part of the longitudinal direction, by using a press forming apparatus which includes a punch, a blank holder disposed adjacent to the punch and slidable in a pressing direction, a die being a counterpart of the punch, and a pad disposed to face the punch and slidable in the pressing direction, wherein the punch has a tip surface, an outside surface, and a stepped surface having shapes corresponding to the web portion, the vertical wall portions, and the flange portion of the product, respectively, the press forming method including:

sandwiching a middle portion in a width direction of the workpiece with the pad and the punch and binding an outer peripheral portion in the width direction of the workpiece with the blank holder and the die;

after making the outer peripheral portion in the width direction of the workpiece get out from between the blank holder and the die by relatively moving the punch and the die in the pressing direction, shaping the web portion and the vertical wall portions, and the flange portion by the die and the stepped surface of the punch; and after shaping the web portion, the vertical wall portions, and the flange portion, relatively moving and separating the punch and the die.

Advantageous Effects of Invention

According to the present invention, a punch has a stepped surface of a shape corresponding to a flange portion, and in a forming process an outer peripheral portion of a workpiece gets out from between a blank holder and a die, so that the flange portion is shaped by the stepped surface of the punch and the die. Thereby, when the punch and the die are separated, the press formed workpiece does not abut on the blank holder, and thus its deformation can be prevented. As described above, it is possible to prevent a deformation of a workpiece at a time of separating a punch and a die without using a locking mechanism. Therefore, there do not occur a problem that a productivity is reduced, a problem that a structure of a metal forming tool or a pressing apparatus becomes complex, and a problem that an equipment cost or a maintenance cost increases, due to the locking mechanism. Further, the present invention is applicable to a pressing apparatus which does not have a locking mechanism.

DESCRIPTION OF EMBODIMENTS

Hereinafter, an embodiment for implementing the present invention will be described with reference to the attached drawing.

Figure 6A:
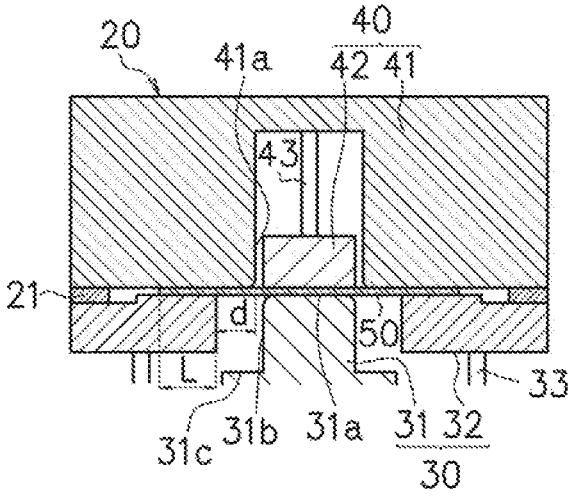
FIG. 6A is a cross-sectional view at a time of sandwiching and binding a workpiece, the cross-sectional view schematically showing a processing flow by a press forming apparatus and a press forming method according to an embodiment.
Figure 6B:
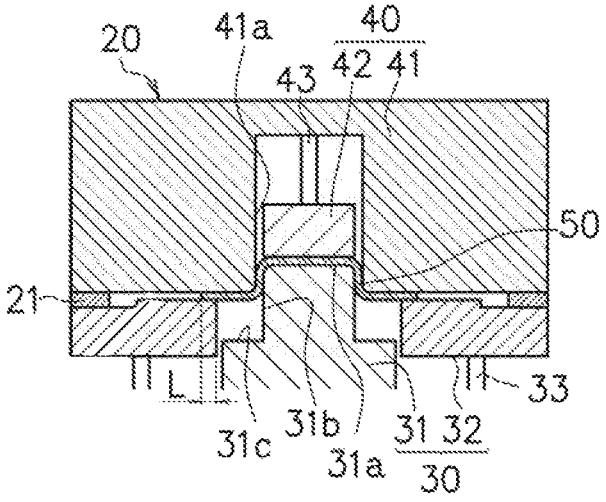
FIG. 6B is a cross-sectional view at a time of pushing, the cross-sectional view schematically showing the processing flow by the press forming apparatus and the press forming method according to the embodiment.
Figure 6C:
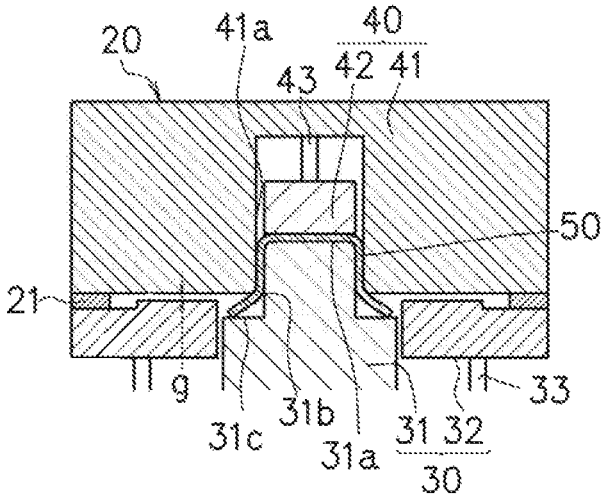
FIG. 6C is a cross-sectional view at a time that the workpiece gets out in press forming, the cross-sectional view schematically showing the processing flow by the press forming apparatus and the press forming method according to the embodiment.
Figure 6D:
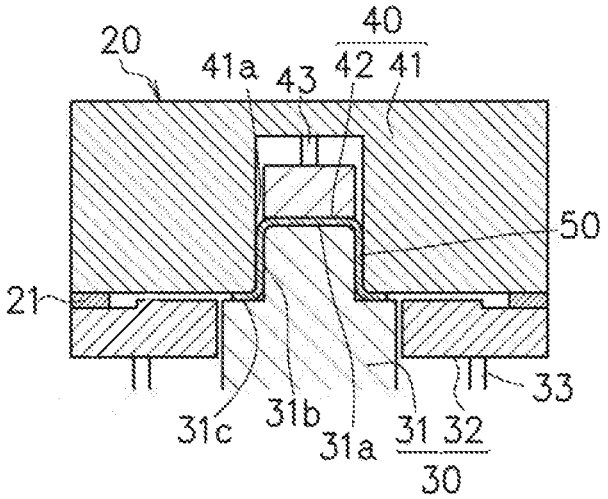
FIG. 6D is a cross-sectional view at a time that an upper forming tool reaches a bottom dead center, the cross-sectional view schematically showing the processing flow by the press forming apparatus and the press forming method according to the embodiment.

FIG. 6A to FIG. 6D are cross-sectional views schematically showing a processing flow by a press forming apparatus and a press forming method according to the embodiment to which the present invention is applied. FIG. 6A shows a time of sandwiching and binding a workpiece, FIG. 6B shows a time of pushing, FIG. 6C shows a time that the workpiece gets out in press forming, and FIG. 6D shows a time that an upper forming tool reaches a bottom dead center, respectively.

Figure 1A:
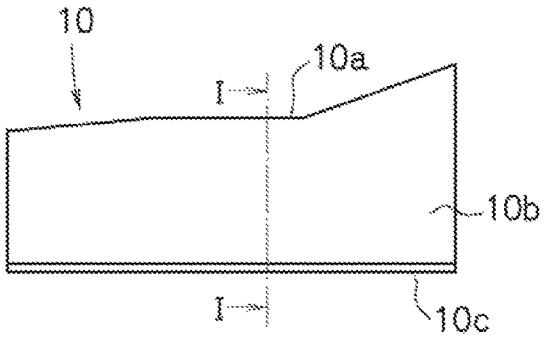
FIG. 1A is a schematic view showing an example of a product with a hat-shaped cross section, and is a side view.

In this embodiment, description is carried out by using an example of press forming to form a product in which a web portion 10*a* is provided with an inclination (see FIG. 1A and FIG. 1B) but a cross-sectional shape is symmetric.

Figure 7:
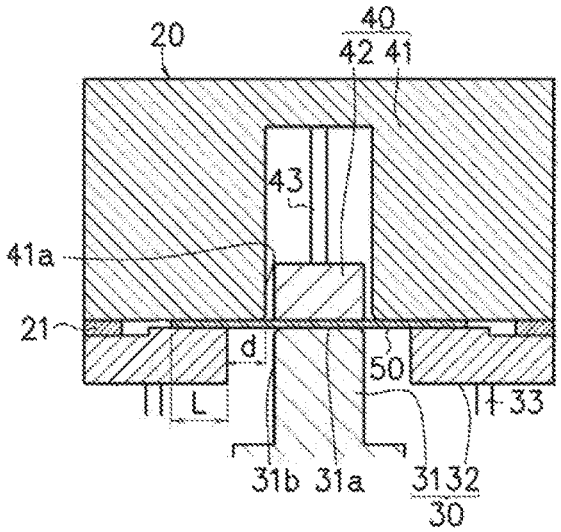
FIG. 7 is a cross-sectional view at another position corresponding to FIG. 6A.

Note that FIG. 7 shows a cross-sectional view at another position corresponding to FIG. 6A. FIG. 6A and FIG. 7A show cases of different timings, and first as shown in FIG. 7, a tall punch pushes the workpiece 50 into a recessed portion of a die 41, and thereafter, as shown in FIG. 6A, a short punch 31 pushes the workpiece 50 into the recessed portion of the die 41. Thereby, it becomes possible to provide the inclination in the web portion 10*a*.

Figure 4A:
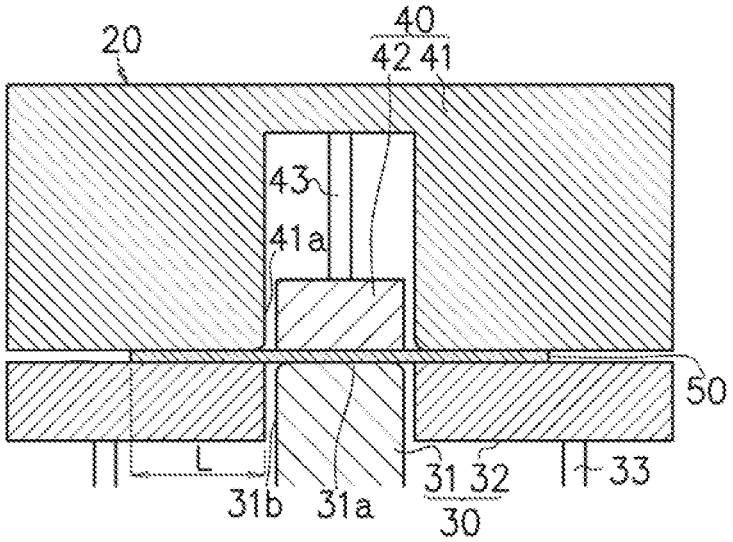
FIG. 4A is a cross-sectional view at a time of sandwiching and binding a workpiece, the cross-sectional view schematically showing a processing flow of a case of using a pad together with a blank holder in press forming.
Figure 4B:
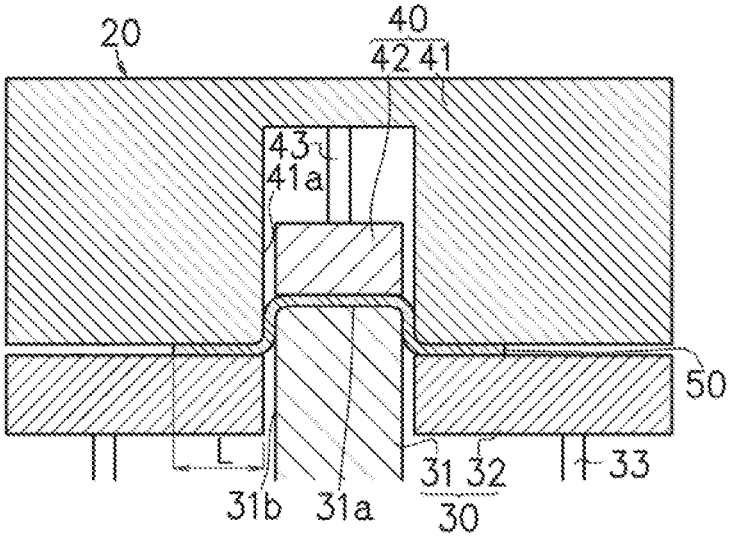
FIG. 4B is a cross-sectional view at a time of pushing, the cross-sectional view schematically showing the processing flow of the case of using the pad together with the blank holder in press forming.
Figure 4C:
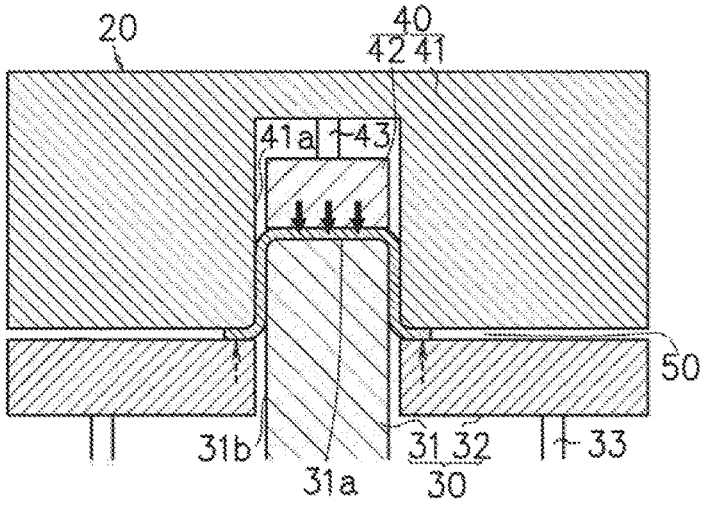
FIG. 4C is a cross-sectional view at a time of starting of separating operation of a punch and a die after a bottom dead center is reached, the cross-sectional view schematically showing the processing flow of the case of using the pad together with the blank holder in press forming.

FIG. 6A to FIG. 6D show a case where the web portion 10*a*, vertical wall portions 10*b*, and flange portions 10*c* are formed in the workpiece when the upper forming tool is lowered from a top dead center to the bottom dead center. In this embodiment, the same reference numeral is given to a component corresponding to a component of the press forming apparatus described in FIG. 4A to FIG. 4C, and description is carried out focusing on differences from FIG. 4A to FIG. 4C.

FIG. 6A to FIG. 6D show the workpiece 50 and a metal forming tool 20 which the press forming apparatus has. In the metal forming tool 20, an upper forming tool 40 is constituted with the die 41 and a pad 42 disposed to face the punch 31, and a lower forming tool 30 is constituted with the punch 31 and blank holders 32 disposed adjacent to the punch 31.

Here, in the lower forming tool 30, a boundary position between the punch 31 and the blank holder 32 is positioned outside the recessed portion of the die 41. More specifically, the punch 31 has a tip surface 31*a* with a shape corresponding to the web portion 10*a* and an outside surface 31*b* with a shape corresponding to the vertical wall portions 10*b*, and in addition, stepped surfaces 31*c* with shapes corresponding to the flange portions 10*c*.

Thereby, in a process of forming the flange portions 10*c*, the vertical wall portions 10*b*, and the web portion 10*a* by relatively moving the punch 31 and the die 41, outer peripheral portions in a width direction of the workpiece 50 get out from between the blank holder 32 and the die 41. This phenomenon is caused by binding lengths L of the workpiece 50 becoming shorter as a result that the workpiece 50 bound by the blank holders 32 and the die 41 is pushed into the recessed portion of the die 41 together with the punch 31 as press forming progresses. Since the outer peripheral portions in the width direction of the workpiece 50 get out from between the blank holders 32 and the die 41 as described above, the flange portions 10*c* are shaped in the workpiece 50 by the die 41 and the stepped surfaces 31*c* of the punch.

A processing flow of the press forming method using such a press forming apparatus will be described.

For press forming, a planar workpiece 50 made of metal is disposed between the die 41 and the punch 31.

In the above state, the workpiece 50 is pressed to the punch 31 by the pad 42, and as shown in FIG. 6A, a middle portion in a width direction of the workpiece 50 is sandwiched by the pad 42 and the punch 31.

Further, the workpiece 50 is pressed to the die 41 by the blank holders 32, and outer peripheral portions in the width direction of the workpiece 50 are bound by the blank holders 32 and the die 41.

It suffices that timings of sandwiching of the middle portion by the pad 42 and the punch 31 and binding of the outer peripheral portions by the blank holder 32 and the die 41 are set properly in correspondence with a shape or the like of a product, similarly to in a conventional method.

Then, the punch 31 and the die 41 are relatively moved to push the workpiece 50 together with the punch 31 into the recessed portion of the die 41, applying drawing to the workpiece 50, so that press forming is carried out. In a forming process thereof, as shown in FIG. 6B, the workpiece 50 is pushed into the recessed portion of the die 41 together with the punch 31, binding lengths L of the workpiece 50 become shorter, and, before long, the outer peripheral portions in the width direction of the workpiece 50 sequentially get out from between the blank holders 32 and the die 41, as shown in FIG. 6C.

After the outer peripheral portions are made to get out from between the blank holders 32 and the die 41, the punch 31 and the die 41 are further moved relatively, whereby the web portion 10*a* is shaped by the tip surface 31*a* of the punch and the pad 42, and the vertical wall portions 10*b* are shaped by the outside surface 31*b* of the punch and the die 41. Further, the flange portions 10*c* are shaped by the stepped surfaces 31*c* of the punch and the die 41. When the upper forming tool reaches the bottom dead center, as shown in FIG. 6D, the tip surface 31*a* of the punch 31 and the pad 42 abut on (touch) the web portion 10*a* formed in the workpiece 50, the outside surface 31*b* of the punch 31 and the die 41 abut on the vertical wall portions 10*b*, and the stepped surfaces 31*c* of the punch 31 and the die 41 abut on the flange portions 10*c*.

After the upper forming tool reaches the bottom dead center, the punch 31 and the die 41 are relatively moved and separated. In the press forming apparatus and the press forming method according to the embodiment, the shaped flange portions 10*c* of the workpiece 50 abut on the stepped surfaces 31*c* of the punch and the die 41 without abutting on the blank holders 32. Therefore, the flange portions 10*c* of the workpiece 50 having been press formed are not pressed by the blank holders 32, and thus the workpiece 50 can be prevented from being deformed when the punch 31 and the die 41 are separated.

As described above, the press forming apparatus and the press forming method according to the embodiment can prevent the press formed workpiece from being deformed at a time of separation, without using a locking mechanism. Accordingly, there do not occur a problem that a productivity is reduced, a problem that a structure of a metal forming tool or a pressing apparatus becomes complex, and a problem that an equipment cost or a maintenance cost increases, due to the locking mechanism. Further, the press forming apparatus and the press forming method according to the embodiment is also applicable to a pressing apparatus which does not have a locking mechanism.

Figure 8:
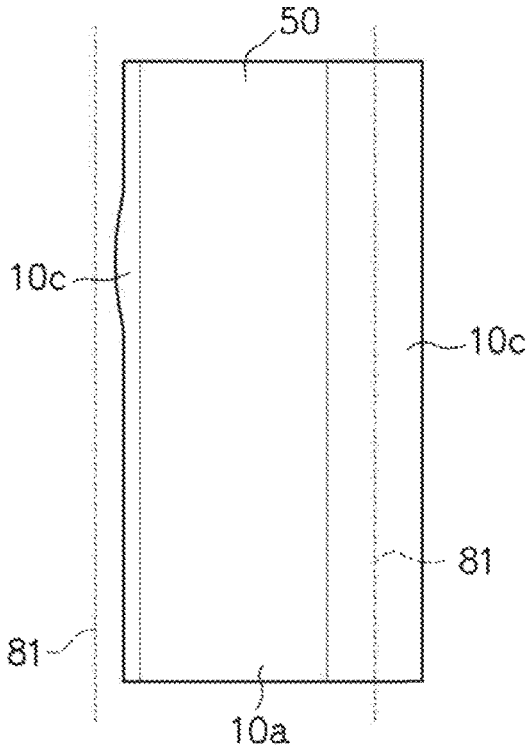
FIG. 8 is a plan view showing an example in which a workpiece remains in a blank holder side and a forming variation occurs.

In the press forming apparatus and press forming method according to the embodiment, as described above, the outer peripheral portions in the width direction of the workpiece 50 are made to get out from between the blank holders 32 and the die 41 sequentially in the forming process, but there is an apprehension that at that time a forming variation occurs when the workpiece 50 remaining in a blank holder 32 side is pressed by a strong pressure. For example, if one of the outer peripheral portions in the width direction of the workpiece 50 positioned in both sides of the recessed portion of the die 41 gets out from the blank holder 32 side and the other remains in the blank holder 32 side, the workpiece 50 remaining in the blank holder 32 side is pressed by a strong pressure. Thereby, there are an apprehension that a material inflow amount of the flange portion 10*c* or the vertical wall portion 10*b* in the side where the outer peripheral portion remains becomes smaller or an apprehension that the workpiece 50 is deviated in the web portion 10*a* in the side where the outer peripheral portion remains. There is an apprehension that shapes of products obtained as above vary. For example, in FIG. 8, dotted lines 81 indicating a positional boundary between the punch 31 and the blank holder 32, there is shown a state where an outer peripheral portion in the left side in the drawing gets out first, an outer peripheral portion in the right side remains in the blank holder 32 side, and a material gathers in the right side.

In order to prevent the above, it is preferable to have a mechanism to keep an interval so that an interval between the blank holder 32 and the die 41 does not become equal to or less than a predetermined interval. In other words, it is preferable to have a mechanism to keep the intervals between the blank holders 32 and the die 41 in a state where the outer peripheral portions in the width direction of the workpiece 50 are bound, in a state where the outer peripheral portions get out of the blank holder 32. Such a mechanism to keep the intervals between the blank holders 32 and the die 41 can be materialized by disposing distance blocks 21 between the die 41 and the blank holders 32, for example. Thereby, even in a state where a part of the outer peripheral portion in the width direction of the workpiece 50 gets out from between the blank holder 32 and the die 41, the workpiece 50 remaining in the blank holder 32 side can be suppressed from being pressed by a strong pressure more than necessary since the distance blocks 21 intervene between the blank holders 32 and the die 41.

It suffices that the distance block 21 is disposed so that the interval between the blank holder 32 and the die 41 is about a plate thickness of the workpiece 50 before a processing in the state where the workpiece 50 gets out, to make a forming variation small. Making the interval between the blank holder 32 and the die 41 be about the plate thickness of the workpiece 50 before the processing means that with the plate thickness (mm) of the workpiece 50 before the processing being "t" and the interval (unit: mm, see FIG. 6C) between the blank holder 32 and the die 41 in the state where the workpiece 50 has got out being "g", the interval "g" is set to satisfy $t \times 0.5 \leq g \leq t \times 1.5$.

In drawing, it is preferable to bind the outer peripheral portion in the width direction of the workpiece 50 at a desired binding force by the blank holder 32 and the die 41, and $g = t \times 1.0$ is preferable. However, considering diverse varieties (a plate thickness variety, a characteristic variety, a material set position variety, slide due to a temperature variety, a metal forming tool shape variety, and so on) or partial thickening, depending on a component shape or the like (change of a component height, an inclination), it is sometimes better to suppress the forming variety due to partial uneven contact caused by diverse varieties, even by somewhat alleviating binding and making the binding force be about $t \times 1.0 \leq g \leq t \times 1.5$. On the other hand, when $g > t \times 1.5$ is satisfied, the binding force to the workpiece 50 becomes small, to cause a wrinkle or the like.

In the press forming apparatus and press forming method of the present invention, the position where the outer peripheral portion in the width direction of the workpiece gets out in the forming process is preferable to be a position of 20 to 99% from a processing start position, and is more preferable to be a position of 50% to 98%.

Here, when a metal forming tool by which press forming is carried out as a result that an upper forming tool moves from a top dead center to a bottom dead center is used as a metal forming tool, for example, the processing start position means a position of the upper forming tool at which position the upper forming tool comes in contact with the workpiece and a processing starts, and a processing end position means the bottom dead center. Further, the position of 98% from the processing start position means a position where a distance (mm) from the processing start position to the upper forming tool becomes 98% of a distance (mm) from the processing start position to the bottom dead center.

In the forming process, when the position where the outer peripheral portion in the width direction of the workpiece gets out is too close to the processing start position, a sufficient effect of drawing cannot be exhibited, and thus there is an apprehension that a wrinkle is formed in the vertical wall portion, for example. In order to prevent the above, the position where the workpiece gets out in the forming process is preferable to be made far from the processing start position to the extent that a forming defect such as a wrinkle does not occur, and more specifically, the position is preferable to be equal to or more than 20% from the processing start position and is more preferable to be equal to or more than 50%.

On the other hand, in the forming process, when the position where the outer peripheral portion in the width direction of the workpiece gets out is too far from the processing start position, there is an apprehension that a part of the workpiece does not get out of the blank holder due to processing varieties. In this case, when separating the punch and the die, there is a possibility that the press formed workpiece is pressed by the blank holder and deformed, leading to a product defect. Thus, the position where the workpiece gets out in the forming process is preferable to be equal to or less than 99% from the processing start position, and is more preferable to be equal to or less than 98%.

Figure 1B:
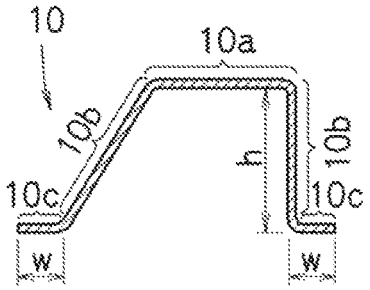
FIG. 1B is a schematic view showing the example the product with the hat-shaped cross section, and is a I-I cross-sectional view of FIG. 1A.
Figure 2A:
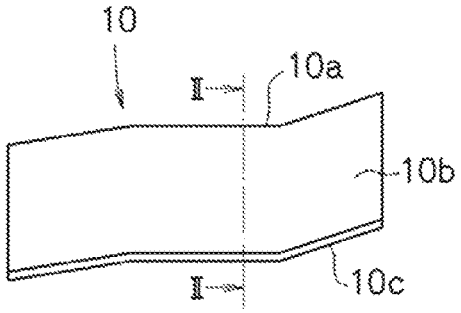
FIG. 2A is a schematic view showing an example of a product with a hat-shaped cross section, and is a side view.
Figure 2B:
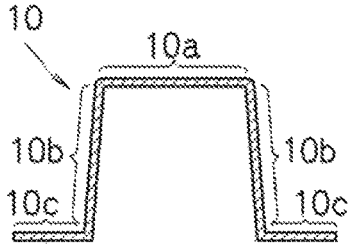
FIG. 2B is a schematic view showing the example of the product with the hat-shaped cross section, and is a II-II cross-sectional view of FIG. 2A.
Figure 3A:
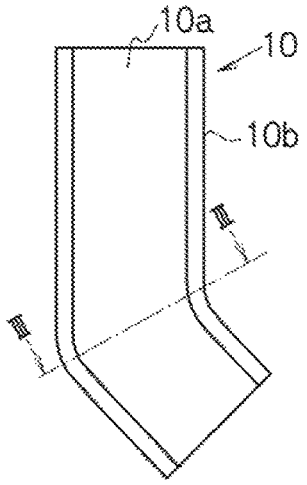
FIG. 3A is a schematic view showing an example of a product with a hat-shaped cross section, and is a plan view.
Figure 3B:
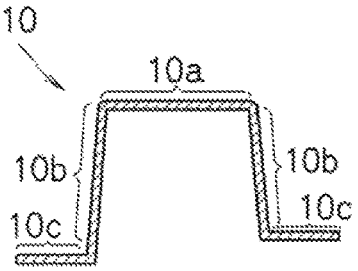
FIG. 3B is a schematic view showing the example the product with the hat-shaped cross section, and is a cross-sectional view of FIG. 3A.

The position where the outer peripheral portion in the width direction of the workpiece gets out in the forming process can be adjusted by changing a distance d from an inside surface of the blank holder 32 to an inside surface 41*a* of the die 41. The distance d from the inside surface of the blank holder 32 to the inside surface 41*a* of the die 41 may be properly changed in correspondence with a required width of the flange portion 10*c* or an elastic recovery amount after forming (spring-back amount). For example, as shown in FIG. 1B, when a width w of a flange portion 10*c* required of a formed portion is 20 mm and a height h of the vertical wall portion 10*b* is 100 mm, and a high-strength steel plate of 1.4 mm in plate thickness and of 590 MPa class is used as the workpiece 50, it suffices that the distance d from the inside surface of the blank holder 32 to the inside surface 41*a* of the die 41 is set to be about 27 mm.

Hereinabove, the present invention is described with various embodiments, but the present invention is not limited only to these embodiments and modification or the like is possible within the scope of the present invention.

In the embodiment, as the metal forming tool, the metal forming tool the upper forming tool of which is constituted with the die and the pad and the lower forming tool of which is constituted with the punch and the blank holder is used, but the press forming apparatus and press forming method of the present invention is not limited to the embodiment using the aforementioned metal forming tool. In other words, it is possible to adopt an embodiment which uses a metal forming tool an upper forming tool of which is constituted with a punch and a blank holder and a lower forming tool of which is constituted with a die and a pad, as a metal forming tool.

Further, though the embodiment is described in which the web portion 10*a*, the vertical wall portions 10*b*, and the flange portions 10*c* are press formed in the workpiece when the upper forming tool is lowered from the top dead center to the bottom dead center, in the press forming apparatus and the press forming method of the present invention, it suffices that the punch and the die are relatively moved in the pressing direction, and the present invention is not limited to the aforementioned embodiment.

Figure 5:
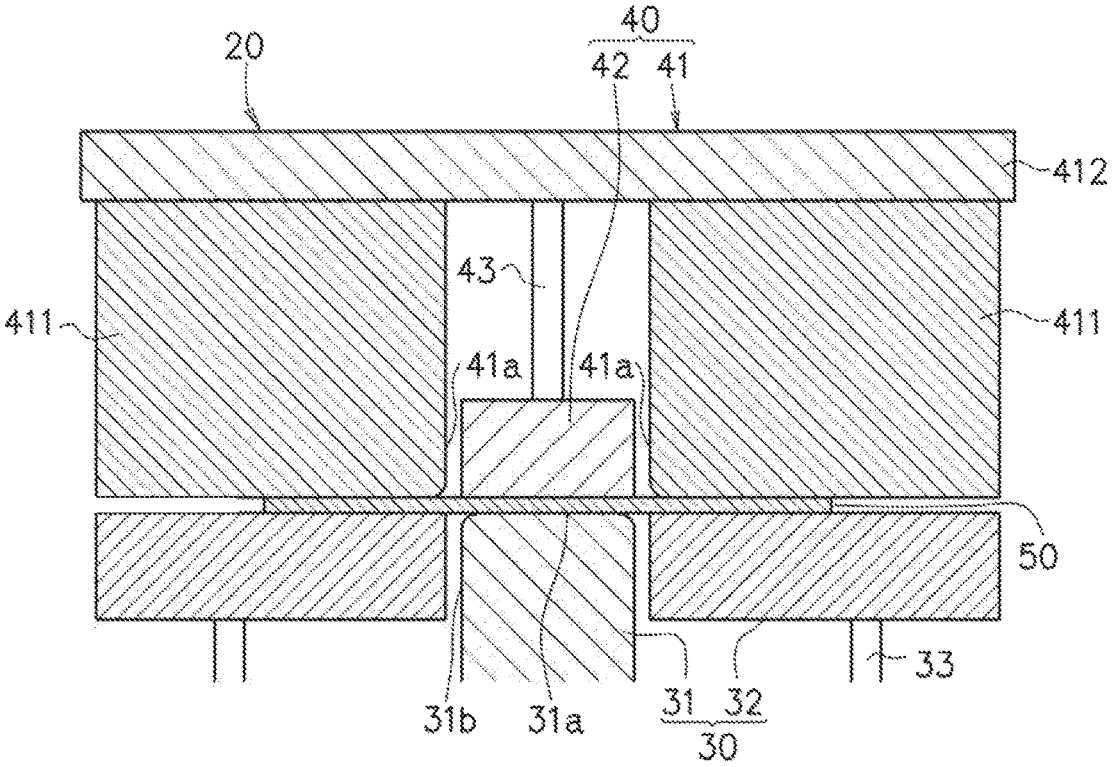
FIG. 5 is a cross-sectional view schematically showing a time of sandwiching and binding a workpiece in press forming using a die constituted with a plurality of components.

In this embodiment, though an example which uses the pad 42 abutting on the entire of the web portion 10*a* to be formed as the pad is described, an embodiment which uses a pad abutting on a part of a web portion 10*a* to be formed can be adopted. Further, the die is not limited to the die constituted with a single member as shown in FIG. 6A to FIG. 6D, and the die constituted with the plurality of members as shown in FIG. 5 can be adopted.

The press forming apparatus and press forming method of the present invention is not limitedly applicable to the product with the hat-shaped cross section, but also is applicable to a case of press forming a product in which a flange portion 10*c* is provided only in one side. In this case, as shown in FIG. 6A to FIG. 6D, it is possible to use the punch 31 which has the stepped surfaces 31*c* in both sides, but it is also possible to use a punch which has a stepped surface only in a side where the flange portion 10*c* is provided. Further, even in a case of application to the product with the hat-shaped cross section, application is possible not only in a case where the flange portion 10*c* is provided throughout the entire length in the longitudinal direction but also in a case where the flange portion 10*c* is provided in a part of the longitudinal direction.

INDUSTRIAL APPLICABILITY

A press forming apparatus and a press forming method of the present invention enable press forming using a pad together with a blank holder at a high productivity and at a suppressed equipment cost. Therefore, application of the press forming apparatus and the press forming method of the present invention to manufacturing of a framework component with a hat-shaped cross-section of an automobile can substantially contribute to improvement of formability and cost reduction of a component difficult to form.

The invention claimed is:

1. A press forming apparatus forming a product by drawing a planar workpiece made of metal, the product having a web portion, a first vertical wall portion extending toward one side of the web portion, a second vertical wall portion extending toward the other side of the web portion, at least one of a first flange portion further extending from the first vertical wall portion in at least a part of a longitudinal direction and a second flange portion further extending from the second vertical wall portion in at least a part of the longitudinal direction, the press forming apparatus comprising:

a punch;

a blank holder disposed adjacent to the punch and slidable in a pressing direction;

a die being a counterpart of the punch; and a pad disposed to face the punch and slidable in the pressing direction, wherein the punch has a tip surface, an outside surface, and a stepped surface having shapes corresponding to the web portion, the vertical wall portions, and the at least one of the first and second flange portions of the product, respectively, wherein the punch, the blank holder, the die and the pad are configured such that as a result that the punch and the die are relatively moved in the pressing direction in a state where a middle portion in a width direction of the workpiece is sandwiched by the pad and the punch and directly opposing surfaces of an outer peripheral portion in the width direction of the workpiece are pressed by the blank holder and the die, the outer peripheral portion in the width direction of the workpiece gets out from between the blank holder and the die and the at least one of the first and second flange portions is shaped by the die and the stepped surface of the punch, and wherein the punch, the blank holder, the die and the pad are configured such that the outer peripheral portion in the width direction of the workpiece gets out from between the blank holder and the die when the position of the punch in relation to the die is in a position of 20 to 99% from a processing start position of drawing of the workpiece to a processing end position.

2. The press forming apparatus according to claim 1, comprising a block to keep an interval so that an interval between the blank holder and the die may not become equal to or less than a predetermined interval.

3. The press forming apparatus according to claim 2, wherein the predetermined interval g satisfies $t \times 0.5 \leq g \leq t \times 1.5$, with a plate thickness of the workpiece before drawing the workpiece being t.

4. The press forming apparatus according to claim 1, wherein the die has a recessed portion, and wherein the punch, the blank holder, the die and the pad are configured such that as a result that the punch and the die are relatively moved in the pressing direction in a state where the middle portion in the width direction of the workpiece is sandwiched by the pad and the punch, and the outer peripheral portion in the width direction of the workpiece is bound by the blank holder and the die, the workpiece is pushed into the recessed portion of the die together with the punch, thereby subjecting the workpiece to drawing, and the vertical wall portions are shaped by the outside surface of the punch and the die, the outer peripheral portion in the width direction of the workpiece gets out from between the blank holder and the die and the at least one of the first and second flange portions is shaped by the die and the stepped surface of the punch.

5. A press forming method to form a product by drawing a planar workpiece made of metal, the product having a web portion, a first vertical wall portion extending toward one side of the web portion, a second vertical wall portion extending toward the other side of the web portion, at least one of a first flange portion further extending from the first vertical wall portion in at least a part of a longitudinal direction and a second flange portion further extending from the second vertical wall portion in at least a part of the longitudinal direction, by using a press forming apparatus which includes a punch, a blank holder disposed adjacent to the punch and slidable in a pressing direction, a die being a counterpart of the punch, and a pad disposed to face the punch and slidable in the pressing direction, wherein the punch has a tip surface, an outside surface, and a stepped surface having shapes corresponding to the web portion, the vertical wall portions, and the at least one of the first and second flange portions of the product, respectively, the press forming method comprising:

sandwiching a middle portion in a width direction of the workpiece with the pad and the punch and pressing directly opposing surfaces of an outer peripheral portion in the width direction of the workpiece with the blank holder and the die;

making the outer peripheral portion in the width direction of the workpiece get out from between the blank holder and the die by relatively moving the punch and the die in the pressing direction;

shaping the web portion and the vertical wall portions, and the at least one of the first and second flange portions by the die and the stepped surface of the punch;

after shaping the web portion, the vertical wall portions, and the at least one of the first and second flange portions, relatively moving and separating the punch and the die; and making the outer peripheral portion in the width direction of the workpiece get out from between the blank holder and the die when the punch in relation to the die is in a position of 20 to 99% from a processing start position of drawing of the workpiece to a processing end position.

6. The press forming method according to claim 5, wherein the die has a recessed portion, and wherein in a step of shaping the web portion and the vertical wall portions, and the at least one of the first and second flange portions, making the workpiece to be pushed into the recessed portion of the die together with the punch thereby subject the workpiece to drawing by relatively moving the punch and the die in the pressing direction, and making the vertical wall portions to be shaped by the outside surface of the punch and the die by relatively moving the punch and the die in the pressing direction, and after making the outer peripheral portion in the width direction of the workpiece get out from between the blank holder and the die by relatively moving the punch and the die in the pressing direction, shaping the web portion and the vertical wall portions, and the at least one of the first and second flange portions by the die and the stepped surface of the punch.

* * * * *